US006736124B2

(12) United States Patent
Carter

(10) Patent No.: US 6,736,124 B2
(45) Date of Patent: May 18, 2004

(54) QUICK RELEASE TRIGGER DEVICE

(76) Inventor: Jerry C. Carter, 487 North 2300 East, St. Anthony, ID (US) 83445

( * ) Notice: Subject to any disclaimer, the term of this patent is extended or adjusted under 35 U.S.C. 154(b) by 0 days.

(21) Appl. No.: 10/360,519

(22) Filed: Feb. 7, 2003

(65) Prior Publication Data

US 2003/0154969 A1 Aug. 21, 2003

Related U.S. Application Data

(63) Continuation-in-part of application No. 09/938,028, filed on Aug. 22, 2001, now Pat. No. 6,631,709.
(60) Provisional application No. 60/355,028, filed on Feb. 7, 2002.

(51) Int. Cl.[7] ..... F41B 5/18
(52) U.S. Cl. ..... 124/35.2

(56) References Cited

U.S. PATENT DOCUMENTS 3,965,884 A * 6/1976 Killian 6,631,709 B2 * 10/2003 Carter et al.

* cited by examiner

*Primary Examiner*—John A. Ricci
(74) *Attorney, Agent, or Firm*—Derek H. Maughan; Frank J. Dykas; Robert L. Shaver

(57) ABSTRACT

A dually adjustable back release archery device that enables a party utilizing the device to vary the configuration of the release in an infinite variety of ways within a designated range. A hook member is adjustably connected to a cam device having a generally smooth half mooned shaped surface that is configured for engagement with a generally flat topped pin that can be alternatively engaged and released so as to allow a desired adjustment of the hook and the cam to be obtained. The device further contains an adjustment between the hook and the cam provided by a set screw and a spring loaded ball that maintain the hook and cam in combination and allow the hook and cam to be fine adjusted according to the necessities of the user.

12 Claims, 2 Drawing Sheets

QUICK RELEASE TRIGGER DEVICE

PRIORITY

This application claims priority from a provisional patent application Serial No. 60/355,028 filed on Feb. 7, 2002 entitled "Quick Release Trigger Device." Additionally, this application is a Continuation-In-Part of U.S. patent application Ser. No. 09/938,028, which was filed on Aug. 22, 2001 now U.S. Pat. No. 6,631,709. The contents of these two prior applications are herein incorporated by reference.

DESCRIPTION

BACKGROUND OF THE INVENTION

1. Field of the Invention

The present invention generally relates to archery, and more particularly to so-called back releases for archery.

2. Background Information

Archers utilize release devices to protect their fingers from injury and to enable them to release a bowstring with minimal adverse influence of involuntary movements made during the aiming of the arrow and releasing of the bowstring. In a manner analogous to the aiming and firing of a rifle or handgun, in which involuntary movements of the hand, finger or other components of the body result in inaccurate striking of a target, so also do such involuntary movements result in inaccurate hitting of an archery target with an arrow.

A major source of such involuntary movements begins with the archer's mental anticipation of moving the hand to pull the trigger of a gun or to release an archery bowstring. When this mental anticipation occurs, the anticipation induces anxiety and tension in the hand and fingers, which translates into involuntary movements. These involuntary movements in turn cause variances in the aiming and alignment of the device with the intended target. This can then result in a variety of unintended consequences including missing a target in competition or a game animal in hunting.

There are a variety of devices that exist in the prior art that are intended to lessen or do away with the unintended consequences of such tension and involuntary movements. Some of these devices include bowstring release devices exist in which a bowstring hook is arranged to hook and pull a bowstring release by pivoting the device laterally about the archer's hand or fingers. Typically, these devices are either not adjustable or are adjustable only within narrowly defined limitations. As a result of this lack of adjustability, these devices may prove to be more of a bother than a benefit as they may require the archer to make movements that are unnatural, and which may cause the arrow to be directed in incorrect directions.

Therefore what is needed is an archery trigger release which provides faithfully reproducible results from an archery device. What is also needed is an archery device that provides an archer with the ability to adjustably modify the orientations and positions of the pieces and parts of the release device so that the bowstring can be drawn and released in a generally natural movement without the attendant problems associated with hand tensioning and involuntary movements.

Accordingly, it is an object of the present invention to provide a bowstring release device that overcomes the aforementioned limitations and disadvantages of prior art bowstring releases. It is a further object of the present invention to provide a bowstring release that allows the aiming and release of an arrow from an archery bow without adverse influence from involuntary movements of the archer. Another object of the present invention is to provide a bowstring release in which the release of a bowstring is achieved by movement of a bowstring hook member from a locked position holding a bowstring in a draw position to a bowstring release position without the archer knowing in advance at what position or under what condition the bowstring is released. A further objective of this invention is to provide a bowstring release in which movement of a bowstring hook member from a locked to a release position is infinitely variable and adjustable and whereby a variety of draw positions and the sensitivity of the bowstring release can be varied. A further object of the present invention is to provide a bowstring release of a simplified construction that is suitable for economical manufacture, which provides an infinite degree of sensitivity, adjustment, and release throughout a desired range.

Additional objects, advantages and novel features of the invention will be set forth in part in the description which follows and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

The present invention is an archery bowstring release that includes a handgrip having a forwardly extending post pivotally mounting a bowstring hook member, which is adjustably engaged, to a pivot mechanism. The pivot mechanism is adjustable by interaction with a post that is in turn engaged by a safety lever to vary and hold the position of a bowstring engaging potion of a hook. The pivot mechanism and the hook are further adjustable by an adjustment means located within the hook that allows for fine travel and fine adjustments to be made. These adjustments place the bowstring hook in a reproducible, repeatable locked position until the hook member is moved a distance sufficient to disengage from the locking portion and release the locking portion, or for the bowstring to release from the hook. The distance that must be traveled to achieve the release is dually adjustable by the two adjustment devices described in the invention.

In use, a party engages the pivot mechanism in a desired position and places a bowstring within a portion of the hook. The party then pulls back on the hook to draw the bow toward a desired position while aiming the arrow at a target. As the party draws the bowstring backward to a full draw position, the wrist which holds the invention will naturally turn at a desired location. When this occurs, the bowstring will release from the release device and the arrow will be projected. In as much as the exact time at which this release occurs is not known to the archer, the archer cannot anticipate this release and make involuntary movements that would alter the path or trajectory of the arrow. This results in better accuracy and precision in shooting arrows using a bow.

The present invention is a dual adjustable arrow release mechanism that enables a party utilizing the device to vary the configuration of the release, and the distances and positions of the parts of the release in an infinite variety of ways within a designated range. In the present embodiment, the hook member is adjustably connected to a cam device having a generally smooth half mooned shaped surface. This cam is configured for engagement with a generally flat topped pin. This pin can be alternatively engaged and released so as to allow a desired adjustment of the hook and the cam to be obtained. The generally smooth, round side of the cam allows the generally flat topped pin to engage the cam in a near infinite variety of positions, and in so doing to vary and alter the position of the hook and the distance that the release and bow string must travel in order to effectuate the release of the bow string from the hook. The pin is configured for connection with a safety lever that together are configured to engage and lock the cam in a desired position. This safety lever is also configured to allow the pin and cam to be released and to disengage the position of the cam with regard to the pin. Once the position of the cam is locked and the bowstring is pulled toward a full draw position, lateral movement of the device will cause the bowstring to disengage from the hook and the projectile to be fired. This disengagement may be obtained by releasing the string directly, or by having the cam, the hook or the combination of the cam and hook slip and release from a locked position when a designated amount of travel and force has been placed upon them.

In addition to the adjustment that can be achieved by varying the position between the smooth faced cam and the pin, further adjustment of the desired lengths and positions of the hook and the cam may be provided by the adjustment means located within the leg portion of the hook and varies the amount of distance and the orientation of the hook with relation to the cam. This feature allows further fine tuning of the release according to the needs of the shooter and the increased precision.

The combination of the smooth faced cam and the adjustment within the hook allows the dual release adjustable mechanism to have nearly infinite varieties of adjustment, so as to accommodate and configure a release mechanism that allows a user to use an archery release that most closely approximates an archers natural movements. Whereby, when the position and release of the bowstring are adjusted to accommodate the necessities of the user, these mechanisms afford a release of the bowstring that is substantially unpredictable and hence uninfluenced by involuntary body movements that otherwise are induced by anxiety and tension in the anticipation of the release of the bowstring.

Further, the purpose of the foregoing abstract is to enable the United States Patent and Trademark Office and the public generally, and especially the scientists, engineers, and practitioners in the art who are not familiar with patent or legal terms or phraseology, to determine quickly from a cursory inspection the nature and essence of the technical disclosure of the application. The abstract is neither intended to define the invention of the application, which is measure by the claims, nor is it intended to be limiting as to the scope of the invention in any way.

Still other objects and advantages of the present invention will become readily apparent to those skilled in this art from the following detailed description wherein I have shown and described only the preferred embodiment of the invention, simply by way of illustration of the best mode contemplated by carrying out my invention. As will be realized, the invention is capable of modification in various obvious respects all without departing from the invention. Accordingly, the drawings and description of the preferred embodiment are to be regarded as illustrative in nature, and not as restrictive in nature.

DESCRIPTION OF THE PREFERRED EMBODIMENTS

Figure 1:
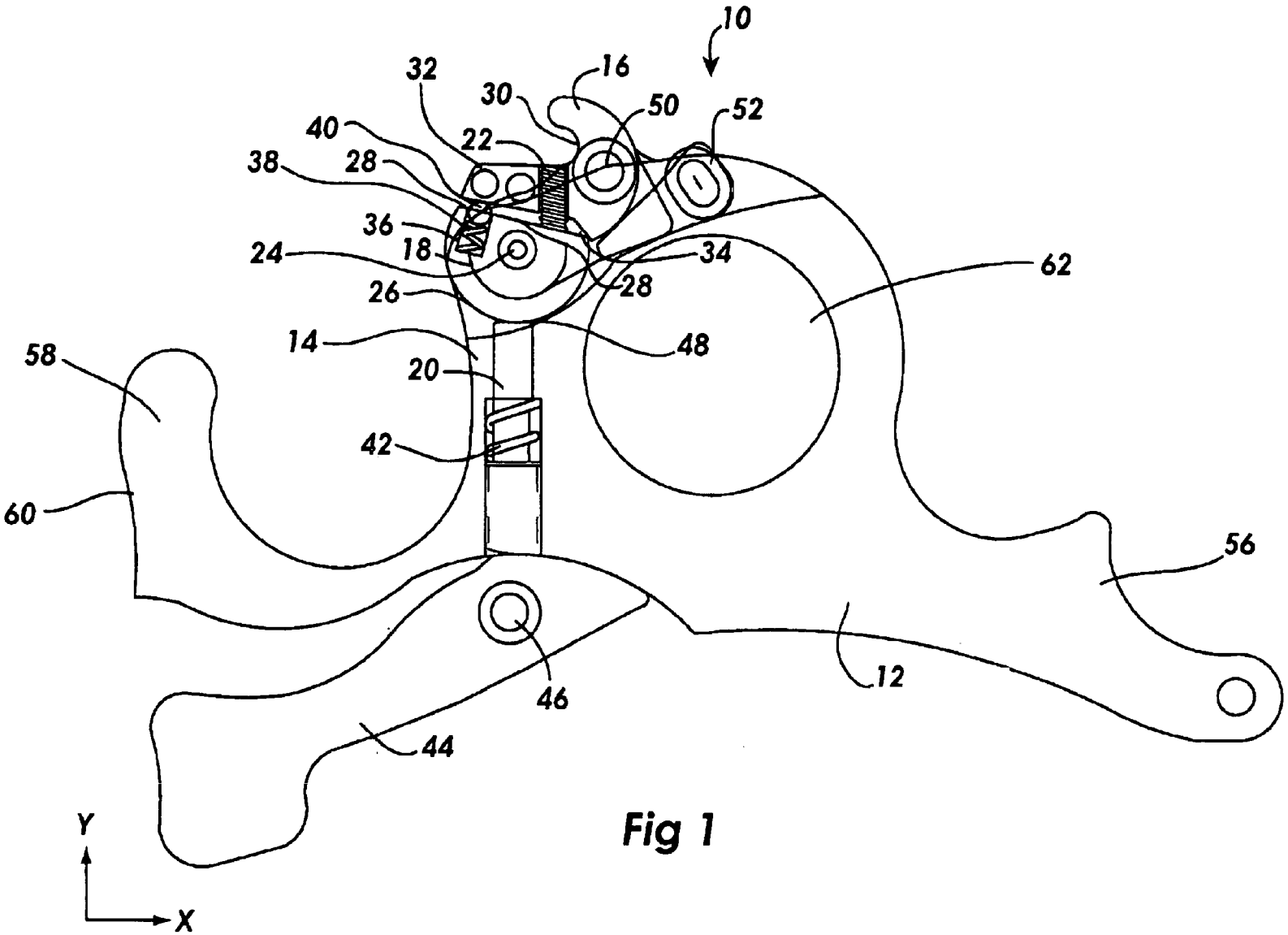
FIG. 1 is a cutaway, detailed, top view of a first embodiment of the present invention.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

The present invention is a new design for a so-called back release for archery. Back releases function by providing a release mechanism that releases a bowstring while an archer is pulling the bowstring back into a full draw position. Since the release comes while the archer is still pulling the device, the archer is generally surprised when the bowstring is released and the arrow is projected from the bow towards a target. This feature eliminates involuntary movements that occur while a party readies to release an arrow with another type of release. In as much as the involuntary movements are eliminated, greater accuracy and precision can be obtained as the archer can more fully concentrate upon aiming the device rather than upon releasing the device.

This style is called back release because, typically, the release of the bowstring from the device occurs as the archer pulls the bowstring with his/her back muscles and squeezes his/her shoulder blades together. When this occurs, the position of the hands tend to move generally laterally and the position of the device is altered. When this occurs past certain point, the release mechanism is triggered and the bowstring is released. Depending upon the specific desires of the archer, the point at which the release is desired may be altered by the present invention. Some of the existing forms of back releases only allow for limited variance in altering the release point and features of the back release. As a result, an archer must move unnaturally to obtain the desired results. This unnatural movement limits the archer's accuracy and efficiency. In as much as each archer is different, the release point and movement for each archer may also be different. The current invention provides a device that overcomes these limitations and provides a dually adjustable device with increased ability to alter and adapt the release parameters of a device by adjusting the inner configuration of the device. The present invention meets these needs.

The general functional parts of the invention are generally indicated in FIG. 1. In use, these portions may be covered by an outer covering which is intended to protect the internal functioning parts. This outer covering may be made of any of a variety of materials according to the desires and necessities of the user.

FIG. 1 shows a cutaway, top view a bowstring trigger release device 10. The device 10 is made up of a handgrip member 12 that has a post portion 14 that extends forward from a grasping portion 56 of the handgrip 12. This handgrip 12 is a rigid structure having a shape conformed to fit with the archer's fingers. The handgrip 12 has an end post 58 and is provided with a thumb surface 60 to support the position of an archer's hand. In this embodiment, an index finger pocket 62 is formed within the handgrip 12. This device 10 is configured so as to allow an archer to comfortably grasp the device 10. While this embodiment is shown as being preferred, it is to be distinctly understood that a variety of other shapes are also contemplated within this disclosure. This would include modifications regarding the number of fingers which would be used to grasp the device along with other design modifications.

The post portion 14 of the handgrip member 12 is configured to pivotally connect with a hook 16 and a cam 18. The hook 16 is made up of an arcuate shaped bowstring engagement portion 30 that is configured to receive and engage a portion of a bowstring therein. The hook 16 is also made up of an extended leg portion 32, an adjustment device 22, and a cam-engaging portion 34. The hook is connected to the post portion 14 of the handgrip member 12 by a hook pivot.

The cam 18 is pivotally connected to the post portion 14 of the handgrip member 12 by a cam pivot connection 24. The cam 18 is shaped in a half moon shape having a generally smooth, round surface 26 and a flat cam surface 28. The round surface 26 is configured to be engaged and held by a pushpin 20. This pushpin 20 is located within the post portion 14 of the handgrip 12 and is slideable up and down to engage and release connection with the round surface 28 of the cam 18. The pushpin 20 is alternatively engaged and released against the round surface 28 of the cam 18 by a safety lever 44 that is pivotally attached to the handgrip 12 by a safety lever pivot 46. When the safety lever 44 is squeezed by a party pulling the device, the pushpin 20 is forced forward against the round surface 28 of the cam 18 and holds the cam 18 from pivoting to another position. When the safety lever 44 is released, a pushpin spring 42 pushes the pushpin 20 away from engagement with the cam 18 and releases the cam 18 to pivot about the pivot connection 24.

This cam design is different from other similar cam mechanisms found in the prior art. For example, in the parent application that is incorporated herein by reference, a similar type of cam had teeth around the outer edges. In that application, the compression of the cam involved a type of ratchet adjustment system that would lock. These teeth therefore would control and limit the ability of the cam 18 to pivot and the amount of engagement between the hook 12 and the cam 18. The new design differs from the parent application in that the new design eliminates these teeth therefore making the position of the cam 18 infinitely adjustable to accommodate the needs of the user.

In the preferred embodiment, the half moon shaped cam 18 has a one-quarter inch radius and is about one half an inch in diameter. The newly designed half moon cam 18 has an infinite amount of adjustment and is not required to be locked in one predefined position. The pushpin 20 in the preferred embodiment is generally round with a flat top portion 48. This flat top portion 48 is configured to allow better engagement of the pushpin 20 with the cam 18. The smooth surface 28 and the flat tipped pin 20 allow better engagement between the cam and the pin and allow for nearly infinite adjustment and positioning of the cam 18 and the connected hook 16 with regard to the post portion 14 of the handgrip 12.

The safety arm 44 pushing up on the pin 20 gives a press fit of two to three thousandths and holds the cam 18 in position after full draw is achieved by the archer. The spring pressure applied by the pushpin spring 42 is different from the device disclosed in the parent application in that the pin spring 42 in the present invention pushes in direction opposite to the direction that the pushpin spring 42 pushes in the other applications.

This combination of features enables an archer using the device to have a variety of advantages. When an archer hooks the release 10 with a bowstring and draws the bowstring back into a desired position full draw position, the safety lever 44 engages the pin 20 in a compression position, an archer hooks the release 10 with the bowstring, and pulls the string back to a full draw. The entire cam 18 and hook 16 pivot around the pin 20 which in turn holds the cam 18 in place. When the archer is in full draw, it will be at some infinite full range or up to 180 degrees from the resting position. By rotating the entire handle grip 10 around the pivot portion 14 housing, the cam 18 is forced to come out from under the hook 12 thereby releasing the hook 12, which then releases the bowstring. The preferred embodiment is configured so that this is done in a generally lateral movement. However, it is to be understood that modifications may be made so that the release 10 will release when moved in other directions as well, including movements in a vertical plane.

The engagement between the hook 16 and the cam 18 are controlled by the adjustment device 22 together with a cam spring 38 and cam ball 40 that are located within a chamber 36 within the cam 18. This figure is shown in greater detail in FIG. 2 of the specification.

Figure 2:
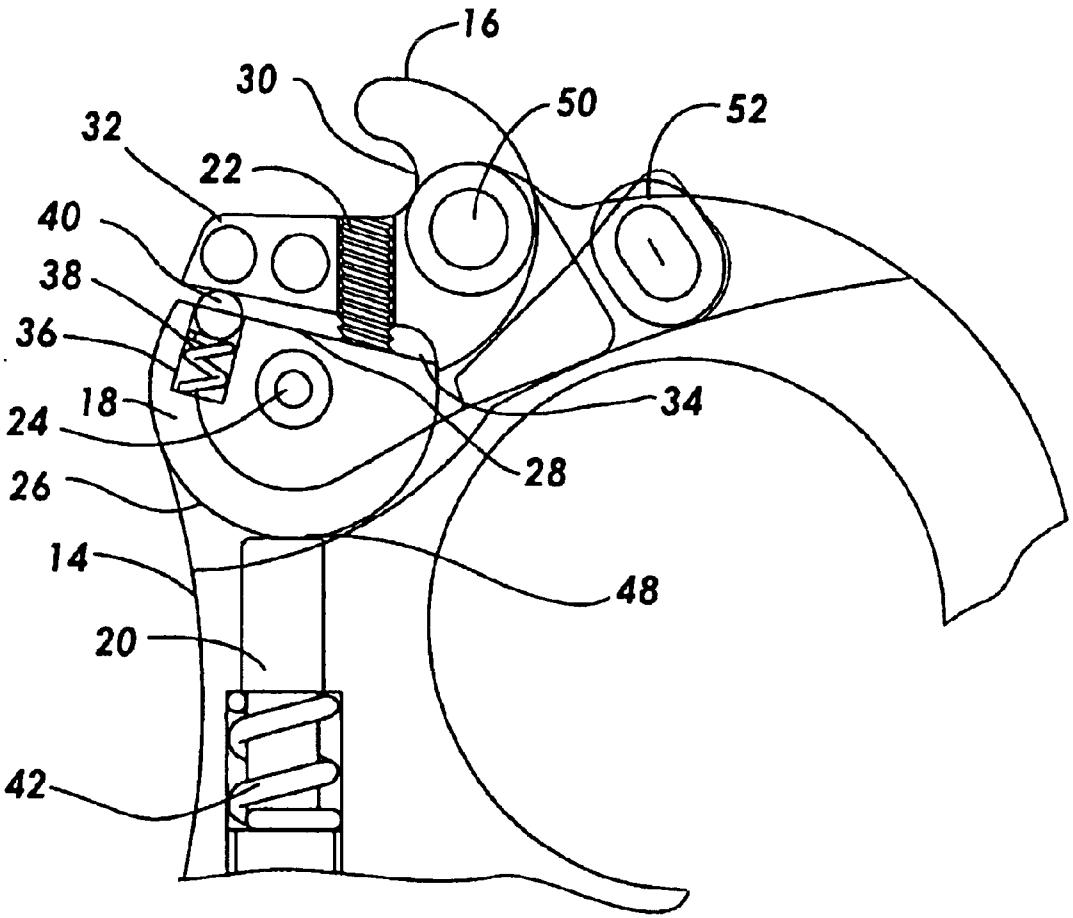
FIG. 2 is a detailed, cutaway, top plan view of the hook of the bowstring-engaging portion of the device.

FIG. 2 shows a detailed version of the view of the embodiment shown in FIG. 1. In this embodiment, the hook 16 has a portion 34 that is configured to engage the cam 18. The adjustment device 22 is a set screw that is configured to increase or decrease the distance between one portion of the flat surface of the cam 28 and the leg portion of the hook 32. The adjustment device 22 is configured to interact with the flat surface of the cam 28 on one side of the pivot connection 24. As this attachment device 22 pushes downward on the flat surface of the cam 28, the cam pivots around the pivot connection 24. As this takes place, the cam ball 40 and the cam spring 38 maintain contact between the cam 18 and the hook 16. This interaction about the pivot connection 24 allows another level of adjustment for the archer so as to modify the direction and angle of hook 18 with regard to the handgrip 12. Excessive rotation of the hook device is provided by the back support structure 52.

While in this embodiment the adjustment device is a set screw, it its to be distinctly understood that the invention is not limited thereto but may be variously embodied according to the desires and necessities of the user. It is to be understood that a variety of other structures may be utilized as an adjustment device, which achieves the same results as the structure set forth in the present specification.

In the preferred embodiment, the set screw is retained in a desired position by rotational adjustment of a screw that is received in the threaded position of the bore that extends thorough the leg portion 32 of the hook 16. The set screw varies the amount of hook 16 and cam 18 engagement which in turn allows the release speed of the bowstring from the hook to vary. The set screw rests within leg 32 on the hook 16 and the flat surface 28 of the moon shaped cam. The set screw is precisely placed in this position on one side of the pivot connection 24 and enables variable adjustments regarding the level of engagement between the hook 16 and the cam 18. The hook 16 is configured for placement within the device in such a way so as to allow a significant amount of affect in adjustment to be achieve with a significantly smaller amount of travel.

The cam ball 40 and the cam spring 38 are located partially within a cam chamber 36 which is located within the cam 18. When the cam 18 is engaged by the pushpin 20, pressure from the cam spring 18 pushes against the cam ball 40 to push the leg of the hook in a clockwise direction. The amount of pressure upon the leg portion of the hook 32 can be modified and adapted based upon the varying the distance between the cam 18 and the leg portion of the hook 32. The amount of pressure on the cam 18 and the hook 16 can be varied by varying the amount of threads protruding out of the hook. Adjusting the set screw can determine the amount of seat engagement between the hook 16 and the cam 18 which in turn alters the position of the bowstring engaging portion of the device 10 and the point at which the bowstring will be released. This device also spring loads the entire assembly and makes a more reliable and fail safe mechanism thereby avoiding misfires. The spring 38 and ball 40 combination also allows a party to adjust the sear engagement to a finer and easier way than would otherwise be possible.

This invention provides a dual adjustable back release style archery release device with the ability to provide nearly infinite degrees of adjustability and allows archers to release a bowstring while pulling a drawstring, thus enabling the archer to eliminate inaccuracies due to involuntary movements and tension related to firing an arrow from a bow.

While there is shown and described the present preferred embodiment of the invention, it is to be distinctly understood that this invention is not limited thereto but may be variously embodied to practice within the scope of the following claims. From the foregoing description, it will be apparent that various changes may be made without departing from the spirit and scope of the invention as defined by the following claims.

I claim:

1. An archery bowstring release comprised of:

a handgrip member configured for manual grasping, said handgrip member having a post portion, a hook configured to engage a bowstring, a cam having a generally smooth rounded surface configured for engagement with a securing device, said cam pivotally connected to said post, said cam configured to operatively engage said post and said hook in a variety of infinitely selectable positions whereby said hook engages said bowstring in a selected first position and releases said bowstring when said handgrip member is laterally tilted to a substantially unpredictable second position;

said securing device configured to adjustably select the angular position of said hook with regard to said post, said securing device configured to control the positioning of said pivot release mechanism and said hook in any one of an infinite variety of selected angular positions with regard to said post portion, and an adjustment device for adjusting the positioning of said pivot mechanism with regard to said hook.

2. The archery bowstring release of claim 1 wherein said securing device is a pushpin located within said post.

3. The archery bowstring release of claim 1 wherein said cam is generally half moon shaped, having a generally smooth pin engaging surface and a generally flat hook engaging surface.

4. The archery bowstring release of claim 1 wherein said hook is configured to have a string engaging portion, an extended leg, and a cam engaging portion.

5. The archery bowstring device of claim 4 further comprising a hook adjusting device located within said hook, said hook adjusting device comprised of an adjustable set screw configured to adjust the position of said hook in relation to said cam.

6. The archery bowstring release device of claim 5 further comprising a leg engaging device connected to said cam, said leg engaging device configured to keep said cam engaging portion of said hook in contact with said cam.

7. The archery release device of claim 6 wherein said leg engaging device is comprised of a pressure engaging device which is held in contact with said leg of said hook by a spring located within a chamber defined within said cam.

8. The archery bowstring release of claim 7 wherein securing device comprises a pushpin which is held in compressive engagement against said cam by a portion of a safety lever connected to said handgrip.

9. An archery bowstring release comprised of:

a handgrip member configured for manual grasping, said handgrip member having a post portion extending forward from a finger portion of said handgrip member, a generally half-moon shaped cam pivotally attached to said post portion of said handgrip member, said cam configured to operatively engage said post portion and a hook in a variety of infinitely selectable positions, thereby allowing said hook to engage said bowstring in selected first position and releases said bowstring when said handgrip member is laterally tilted to a substantially unpredictable second position, and a generally round pin having a generally flat portion top portion, said pin slidingly positioned within said post portion and configured to adjustably select the angular position of the hook with regard to said post portion by compressively engaging said half-moon shaped cam, thereby selecting the angular position of said hook with regard to said post, said securing device configured to control the positioning of said cam in any one of an infinite variety of selected angular positions with regard to said post.

10. The archery bowstring of release of claim 9 wherein said hook is a string engaging portion, an extended leg, a cam engaging portion, and an adjustment device configured to select the position of said hook with regard to said cam, said adjustment device comprised of a set screw connected within said hook.

11. The archery bowstring release of claim 10 wherein said cam further defines a chamber, said chamber containing a spring and a ball therein, said ball and spring configured to provide upward pressure against said extended leg of said hook.

12. An archery bowstring release comprising:

a handgrip member having a post;

a bowstring hook;

a half moon cam with a smooth surface pivotally attached to said post, said half moon shaped cam configured to engage said post and said hook in infinitely selectable positions; and a pin slidably positioned within said post, said pin configured to compressively engage said cam to select the angular position of said bowstring hook relative to said post.

* * * * *